US008103031B2

(12) United States Patent
Ho et al.

(10) Patent No.: US 8,103,031 B2
(45) Date of Patent: Jan. 24, 2012

(54) HEARING DEVICE SOUND EMISSION TUBE WITH A 2-COMPONENT DESIGN

(75) Inventors: Wai Kit David Ho, Singapore (SG); Wee Haw Koo, Singapore (SG); Wee Loong Ng, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 875 days.

(21) Appl. No.: 12/143,201

(22) Filed: Jun. 20, 2008

(65) Prior Publication Data

US 2008/0317272 A1 Dec. 25, 2008

(30) Foreign Application Priority Data

Jun. 20, 2007 (DE) ..... 10 2007 028 225

(51) Int. Cl.
*H04R 25/02* (2006.01)

(52) U.S. Cl. ..... 381/322; 381/330

(58) Field of Classification Search ..... 381/322, 381/330, 328, 382, 381; 29/896.21
See application file for complete search history.

(56) References Cited

U.S. PATENT DOCUMENTS

| | | | | |
|---|---|---|---|---|
| 4,006,796 | A * | 2/1977 | Coehorst | 181/130 |
| 4,870,688 | A * | 9/1989 | Voroba et al. | 381/60 |
| 6,339,648 | B1 * | 1/2002 | McIntosh et al. | 381/328 |
| 6,584,207 | B1 | 6/2003 | Yoest et al. | |
| 2002/0025055 | A1 * | 2/2002 | Stonikas et al. | 381/322 |
| 2005/0249371 | A1 * | 11/2005 | Vogt | 381/330 |

FOREIGN PATENT DOCUMENTS

| | | |
|---|---|---|
| EP | 1 492 383 A1 | 12/2004 |
| NL | 8601513 | 6/1986 |
| WO | WO 2006/125434 A1 | 11/2006 |

* cited by examiner

*Primary Examiner* — Allan R Wilson
(74) *Attorney, Agent, or Firm* — Schiff Hardin LLP

(57) ABSTRACT

A hearing device, in particular a hearing system, is designed more acoustically stable with regard to feedback as well as more mechanically stable with regard to external influences by a sound emission tube for direct connection to an output nozzle of an earpiece of a hearing device. The sound emission tube has an outer sheath made from a first plastic and an inner wall made from a second plastic that is more elastic than the first plastic. The outer sheath and the inner wall are produced by 2-component injection molding. The inner wall damps vibrations from the earpiece outward or shocks from the outside to the earpiece. Conversely, the outer sheath provides for the mechanical stability and the sufficiently rigid mounting of the earpiece.

6 Claims, 3 Drawing Sheets

HEARING DEVICE SOUND EMISSION TUBE WITH A 2-COMPONENT DESIGN

BACKGROUND OF THE INVENTION

1. Field of the Invention

The present invention concerns a sound output tube for direct connection to an emission port of an earpiece (earphone) of a hearing device that is produced as an injection molded part. In this context, a "hearing device" encompasses an in-the-ear device such as a hearing system, a headset, headphones and the like.

2. Description of the Prior Art

Hearing systems are wearable hearing devices that serve to assist hearing impaired persons. In order to meet the numerous individual requirements, different structural shapes of hearing systems such as behind the ear (BtE) hearing systems and in the ear (ItE) hearing systems as well as concha hearing systems or completely in canal (CIC) hearing systems are provided, for example. These hearing systems listed as examples are worn on the outer ear or in the auditory canal. Moreover, bone conduction hearing aids, implantable, and vibrotactile hearing aids are also commercially available. The stimulation of the damaged ear ensues either mechanically or electrically.

In principle hearing systems have as basic components an input transducer, an amplifier and an output transducer. The input transducer is normally a sound receiver (for example a microphone) and/or an electromagnetic receiver (for example an induction coil). The output transducer is usually realized as an electro-acoustic transducer (for example a miniature speaker) or as an electromechanical transducer (for example a bone conduction earpiece). The amplifier is typically integrated into a signal processing unit. This basic design is shown in FIG. 1 in the example of a behind the ear hearing system. One or more microphones 2 for acquisition of the sound from the environment are installed in a hearing device housing 1 to be worn behind the ear. A signal processing unit 3 that is likewise integrated into the hearing device housing 1 processes the microphone signals and amplifies them. The output signal of the signal processing unit 3 is transferred to a speaker or earpiece 4 that outputs an acoustic signal. The sound is possibly transferred to the eardrum of the system wearer via a sound tube that is fixed in the auditory canal with an otoplastic. The power supply of the hearing system and in particular that of the signal processing unit 3 ensues via a battery 5 likewise integrated into the hearing device housing 1.

The earpiece 4 is connected with its output to a connection piece 6. This simultaneously serves as a mechanical plug connection or, respectively, fastening possibility for a support hook 7 as well as for transfer of the amplified sound from the earpiece 4 into a sound channel 8 of the support hook 7. From the support hook 7 the sound is typically directed to the auditory canal via a sound tube (not shown).

Given such a design of a BtE hearing system the danger exists that the earpiece transfers vibrations to the support hook or, respectively, the hearing device housing. The acoustic properties of the hearing system thereby change and in particular unintentional feedbacks arise. This means that the transfer function of the hearing system exhibits distinct spikes (peaks).

A solution to this problem is to design the connection piece from a softer material. Alternatively, a short sound emission tube that consists of a soft material is also inserted between the earpiece and the connection piece. However, this leads to the further problem that the earpiece is no longer held firmly enough in the hearing device housing. Given vibrations it can consequently strike the hearing device housing, whereby the acoustic stability is in turn reduced. Conversely, shocks that act on the hearing system from the outside can also be transferred to a less firmly seated earpiece. The risk exists that the earpiece is damaged or destroyed. The stability of a hearing system is checked in drop tests with which it can be simulated how robustly the hearing system responds upon being dropped.

Drop tests and earpiece vibrations require a damped mounting of the earpiece in the hearing device housing. A corresponding installation space therefore must be provided in the hearing device housing so that the earpiece can execute movements in a defined frame. Multiple corresponding adhesives or reinforced microphone hangings are utilized in order to achieve a damped mounting in this space. Moreover, it is also known to embed the earpiece in a polyurethane mold or to affix the hearing device housing with a soft silicone glue.

A soft sound emission tube and soft hangings of the earpiece lead to better acoustic properties of the hearing system or of the hearing device. However, this also requires a larger installation space for the earpiece since this must in particular be able to move correspondingly, in particular in drop tests. A compromise is thus sought that allows an optimally small installation space but in which the vibrations of the earpiece or of the hearing device housing are simultaneously sufficiently absorbed. Tradeoffs thus must be made between acoustic stability and mechanical design.

A hook for a hearing system is known from WO 2006/125434 A1. The hearing system hook has damping means in order to damp its mechanical vibrations. In particular a multipart hook is proposed whose middle part consists of a damping material. The hook can as a whole be produced in a multi-component injection molding method. Silicone is suitable as a damping material, for example.

A hearing system in which at least two of the parts to be assembled thereon are produced from different materials in two-component or multi-component injection techniques are known from the printed document EP 1 492 383 A1. For example, a seal is injected as well in a border region of a shell part in a two-part or multi-part shell of a hearing system.

SUMMARY OF THE INVENTION

An object of the present invention is to provide a mounting in an earpiece of a hearing device that is sufficiently stable with regard to external influences, while also damping the vibrations of the earpiece to a sufficient degree.

According to the invention, this object is achieved by a sound emission tube for direct connection to an output nozzle of an earpiece of a hearing device that is produced as an injection molded part, formed by an outer sheath made from a first plastic and an inner wall made from a second plastic that is more elastic than the first plastic, wherein the outer sheath and the inner wall are produced by 2-component injection molding.

The inventive 2-component sound emission tube with its hard outer sheath achieves the function of a stable mounting of the earpiece in an advantageous manner. Moreover, the soft, elastic inner wall ensures the necessary absorption of the earpiece vibrations.

In an embodiment of the sound emission tube, the first plastic is a silicone material and the second material is a softer silicone material. Not only is a very reliable material therefore selected, but also a high-quality 2-component injection molded part can also be achieved since both components are based on silicone.

According to a further embodiment, the sound emission tube can be formed as a pipe bend. The spatial conditions in a hearing device housing can better accommodated with this.

Moreover, it can be advantageous embodiment when the outer sheath does not extend over the entire length of the sound emission tube. No vibrations are thus transferred from the earpiece to the housing of the hearing device or vice versa via the relatively rigid outer sheath.

In a preferred embodiment, a BtE hearing system is provided with an earpiece, a support hook, a connection piece for sound transfer in the support hook and a sound emission tube as it is described above that acoustically connects the output nozzle of the earpiece with the connection piece. The BtE hearing system, as is generally required, can be designed more compactly since the earpiece is mounted more stably on the one hand and in a vibration-damping manner on the other hand on the support hook or the hearing device housing.

DESCRIPTION OF THE PREFERRED EMBODIMENTS

The exemplary embodiment depicted in detail in the following represents a preferred embodiment of the present invention.

Figure 1:
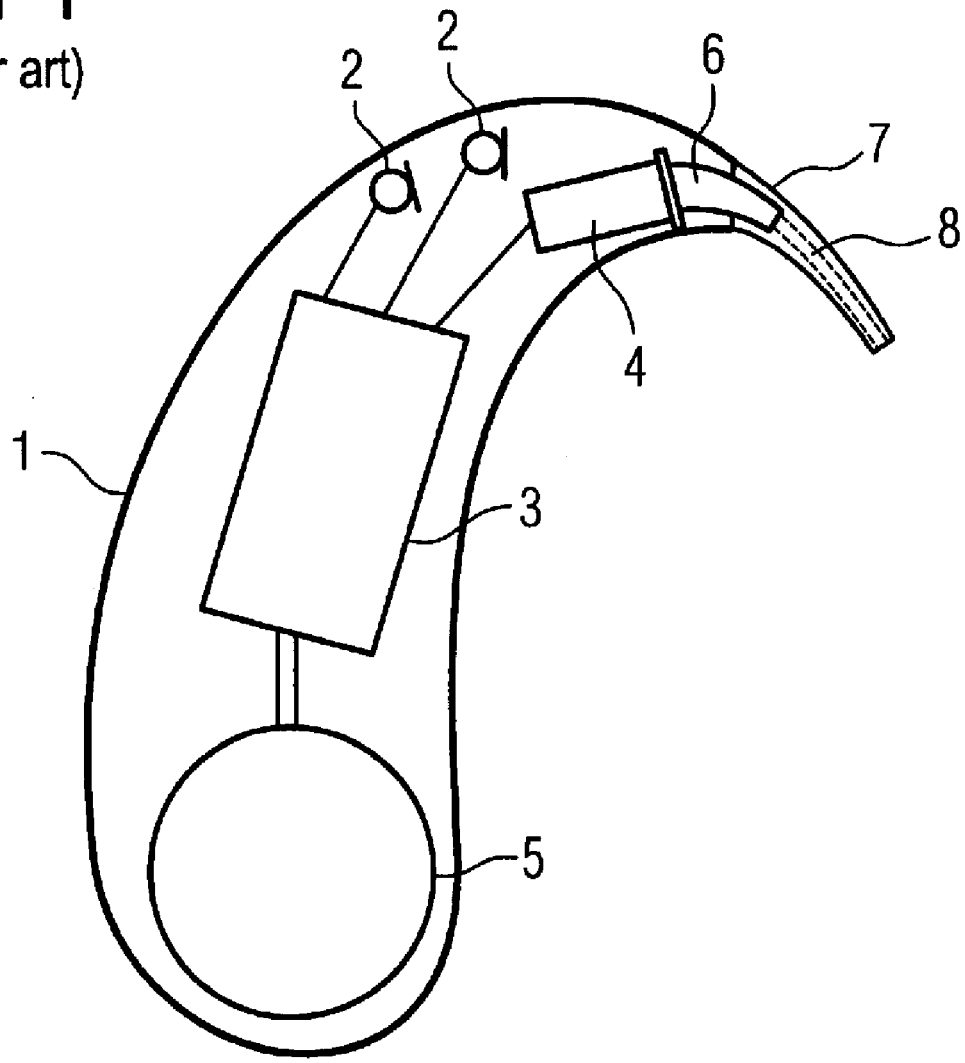
FIG 1 (Prior art)
FIG. 1 shows the basic design of a hearing system with its essential components according to the prior art.
Figure 2:
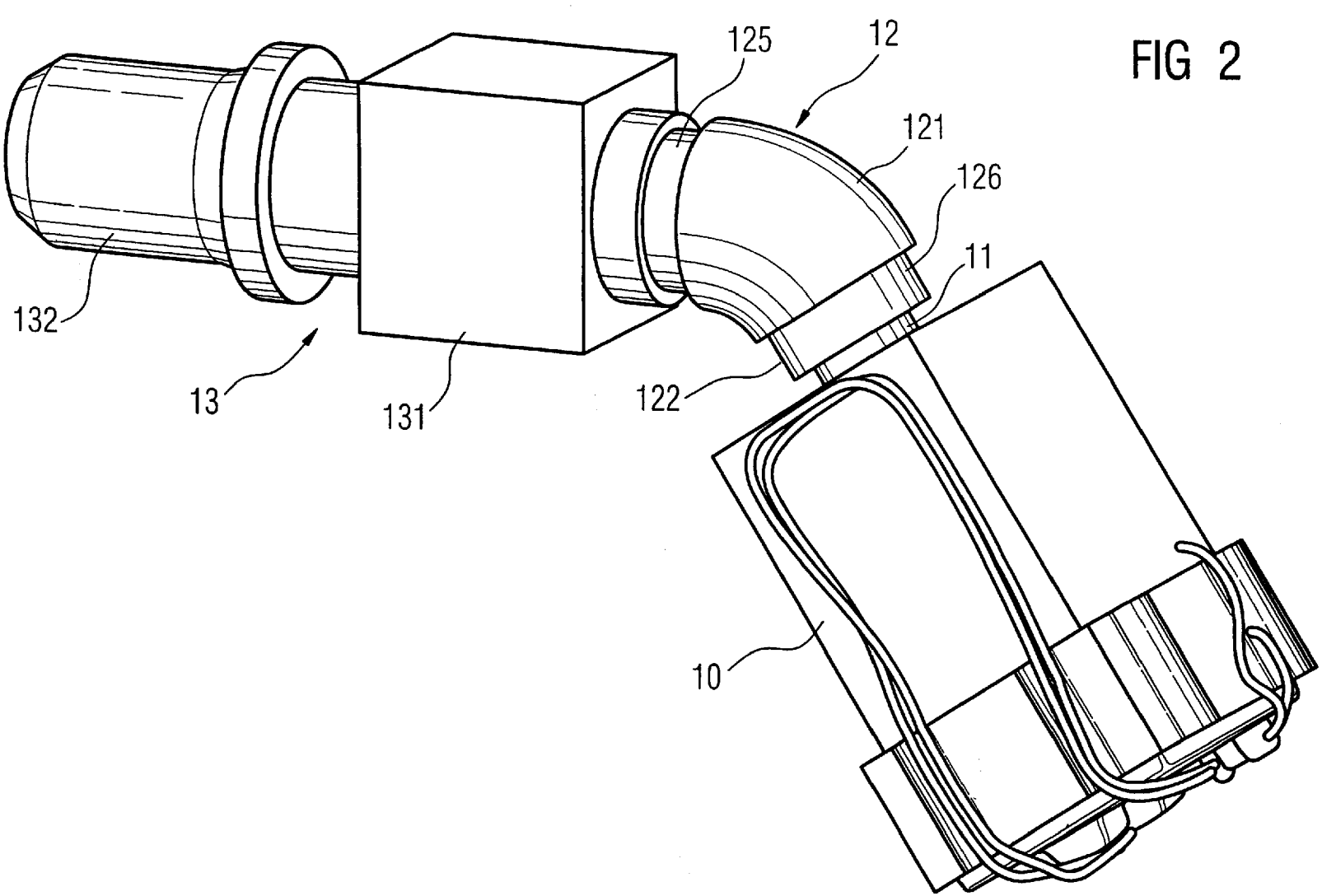
FIG. 2 is a 3-D representation of an earpiece connected to a connection piece with the aid of a sound emission tube according to the invention.

An earpiece 10 shown in FIG. 2 has a sound emission nozzle 11. A sound emission tube 12 is attached to this sound emission nozzle 11. This sound emission tube 12 is designed in an arc shape and internally conducts the sound of the earpiece 10 further to a connection piece 13. For this the connection piece 13 is attached to the end of the sound emission tube 12 situated opposite the earpiece 10.

The connection piece 13 is essentially fashioned as a tube and serves as an adapter. It has at the one end a mounting part 131 with which it is fastened on the housing of the hearing device or the hearing device housing. At its other end of the connection piece 13 has a plug part 132 onto which a support hook 7 is plugged. The connection piece 13 can also be connected as one part with the housing of the hearing device and in particular can be injection molded as one part. In the case of an ItE hearing system, the sound emission tube 12 can also be directly connected with a sound emission element of the hearing system shell.

Figure 3:
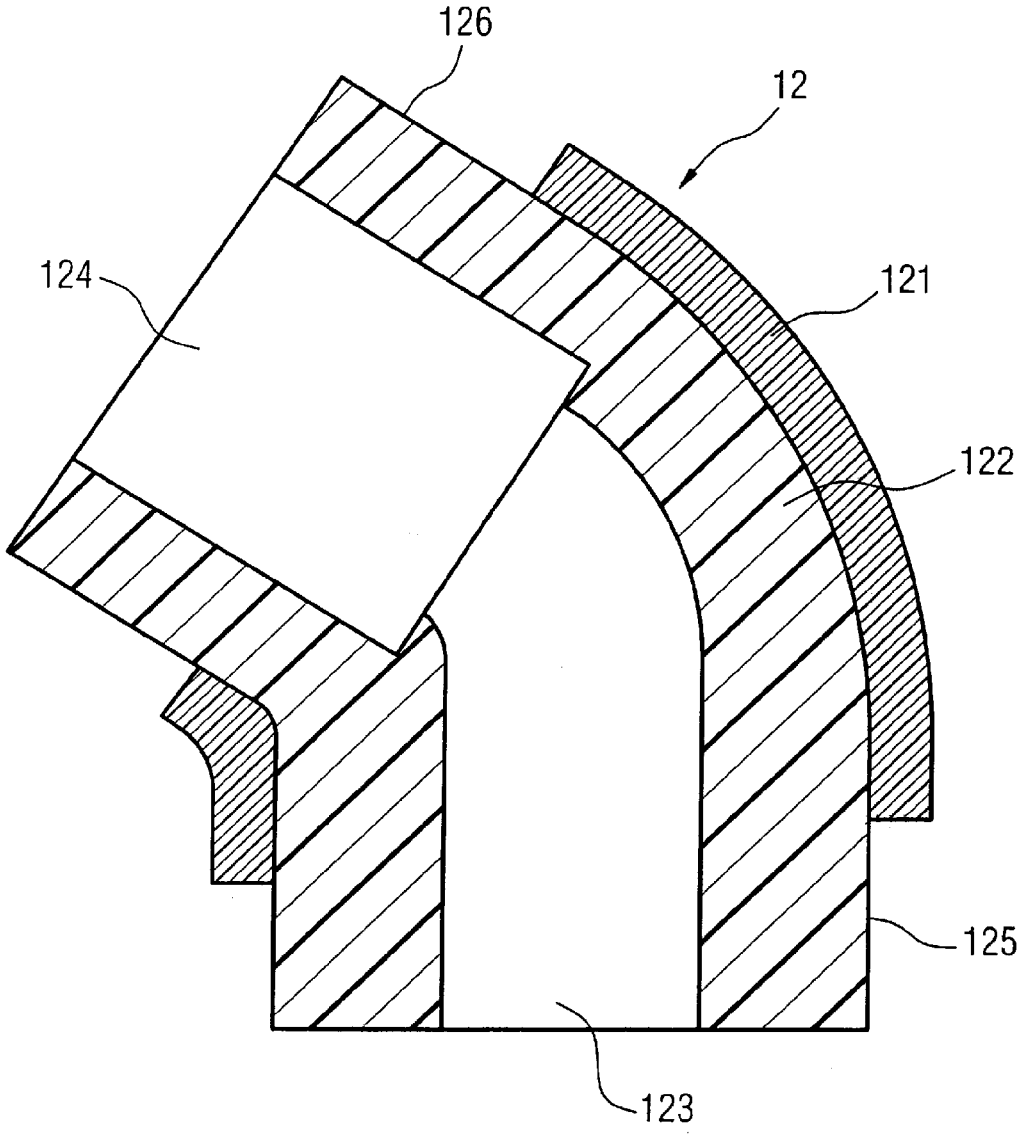
FIG. 3 is a longitudinal section view of the sound emission tube according to the invention.

According to the invention the sound emission tube 12 is produced in a 2-component injection molding method (overmold technology). It essentially consists of two component: a hard outer sheath 121 and a softer or more elastic inner wall 122. A longitudinal section through the sound emission tube 12 is shown in FIG. 3. A soft inner wall 122 is thus injected into the outer sheath 121 or a harder outer sheath 121 is injected around the soft inner wall 122.

The sound emission tube 112 internally possesses a sound channel 123. At the side of the earpiece 10 this sound channel 123 is extended to a cylindrical receptacle 124 so that the sound emission tube 12 can be connected to the sound emission nozzle 11 of the earpiece 10.

The outer sheath 121 does not extend over the entire arc length of the inner wall 122 or, respectively, of the sound channel 123 including receptacle 124. Rather, a tube-shaped inner wall part 125, 126 respectively projects from the outer sheath 121 both on the side at the earpiece 10 and at the side at the connection piece 13. These projecting segments 125 and 126 of the inner wall 122 ensure that the outer sheath 122 does not directly come into contact with the housing or sound emission nozzle 11 of the earpiece 10 or the connection piece 13. It is thus prevented as much as possible that vibrations are transferred via the outer sheath 121. The soft or elastic inner wall 122 damps the vibrations in a desired manner. The object of the outer sheath 121 is merely to mechanically stabilize the inner wall 122 as much as possible. For example, it can hereby be prevented that the earpiece 10 strikes a wall of the hearing device housing when the hearing system is dropped.

The projecting parts 125 and 126 are necessary only inasmuch as the danger exists that the rigid outer sheath 121 comes into direct contact with one of the two connection components 10, 13. Finally, vibrations that the earpiece 10 itself generates are therefore also not transferred out to the hearing device or support hook. Thus ultimately also leads to a reduction of feedback.

In the present example the inner wall 122 consists of a soft silicone and the outer wall 121 consists of a hard silicone.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing device sound emission tube comprising:

an injection molded part forming a hearing device sound emission tube having a tube length, said injection molded part having an end configured for direct connection to an output nozzle of an earpiece of a hearing device;

said injection molded part comprising an outer sheath consisting of a first plastic and having an inner wall, forming a wall of said sound emission tube, consisting of a second plastic that is more elastic than said first plastic, said outer sheath terminating short of said tube length; and said outer sheath and said inner wall being formed by a 2-component injection molding.

2. A sound emission tube as claimed in claim 1 wherein said first plastic is a first silicone material having a first softness, and said second plastic is a second silicone material having a second softness that is softer than said first softness.

3. A sound emission tube as claimed in claim 1 wherein said injection molded part forms a pipe bend.

4. A behind the ear hearing system comprising:

a hearing device having an ear piece with an output nozzle at which sound is emitted, and having a support hook and a connection piece for transferring sound in said support hook;

an injection molded part forming a hearing device sound emission tube having a tube length, said injection molded part having an end configured for direct connection to said output nozzle; and said injection molded part comprising an outer sheath consisting of a first plastic and an inner wall forming a tube wall of said sound emission tube consisting of a second plastic that is more elastic than said first plastic, said outer sheath terminating short of said tube length, and said other sheath and said inner wall being produced by a 2-component injection molding.

5. A behind the ear hearing system as claimed in claim 4 wherein said first plastic is a first silicone material having a first softness, and said second plastic is a second silicone material having a second softness that is softer than said first softness.

6. A behind the ear hearing system as claimed in claim 4 wherein said injection molded part forms a pipe bend.

* * * * *